US006227157B1

(12) United States Patent
Baumgartner et al.

(10) Patent No.: US 6,227,157 B1
(45) Date of Patent: May 8, 2001

(54) ENGINE GLOW PLUG SYSTEMS AND METHODS

(75) Inventors: Kenneth A. Baumgartner; Michael A. Caruthers; Christopher F. Gallmeyer, all of Peoria; Robert L. Miller, Dunlap; Kenneth J. Suda, Edelstein, all of IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/309,102

(22) Filed: May 10, 1999

(51) Int. Cl.[7] ..... F02B 9/00; F02P 9/00

(52) U.S. Cl. ..... 123/145 A

(58) Field of Search ..... 123/145 A, 179.21, 123/179.6, 606, 607, 608; 315/209 R, 209 SC, 209 T

(56) References Cited

U.S. PATENT DOCUMENTS

| | | | | |
|---|---|---|---|---|
| 4,307,689 | | 12/1981 | Raeske et al. | 123/179 H |
| 4,359,643 | * | 11/1982 | Tada et al. | 123/145 A |
| 4,399,781 | | 8/1983 | Tsukasaki | 123/179 H |
| 4,483,284 | * | 11/1984 | Andreasson | 123/179.21 |
| 4,658,772 | | 4/1987 | Auth et al. | 123/145 A |
| 4,710,681 | * | 12/1987 | Zivkovich | 315/209 T |
| 4,820,957 | * | 4/1989 | Zivkovich | 315/209 T |
| 5,144,922 | | 9/1992 | Kong | 123/145 A |
| 5,287,831 | * | 2/1994 | Andersen et al. | 123/179.3 |
| 5,367,994 | | 11/1994 | Hinkle | 123/145 A |
| 5,413,072 | | 5/1995 | Anderson et al. | 123/145 A |
| 5,568,801 | * | 10/1996 | Paterson et al. | 123/598 |
| 5,570,666 | | 11/1996 | Rymut et al. | 123/145 A |
| 5,724,932 | | 3/1998 | Antone | 123/145 A |
| 5,809,957 | | 9/1998 | Antone et al. | 123/145 A |

OTHER PUBLICATIONS

M. Osenga, "Diesel Progress", Aug. 1998, pp. 82, 84, and 86.

R. L. Miller, et al., Development of a Heavy–Duty, Flexible Fuel (Methanol–Diesel) . . . , ASME, ICE–vol. 27–3,Book No. 1011C, 1996, 47–55.

* cited by examiner

*Primary Examiner*—Henry C. Yuen
*Assistant Examiner*—Hieu T. Vo
(74) *Attorney, Agent, or Firm*—Gordon H. Telfer

(57) ABSTRACT

An AC glow plug system is provided that includes a static converter for DC to AC conversion. Control techniques include varying the converter duty cycle according to glow plug temperature and other parameters such as engine air or coolant temperatures for smooth running as well as for prolonging glow plug life. Control is also varied according to fuel system characteristics and fuel composition.

24 Claims, 2 Drawing Sheets

ENGINE GLOW PLUG SYSTEMS AND METHODS

TECHNICAL FIELD

This invention relates to glow plug systems for internal combustion engines, and particularly to power sources for glow plugs and operating methods for glow plugs.

BACKGROUND ART

Glow plugs have been used to help initiate combustion in diesel engines. At one time, glow plugs, if used at all, were included just to minimize cold starting problems. Other uses were limited by concerns about the operating life of the glow plugs. Glow plug life was improved by making them with durable ceramic material such as silicon nitride. However, such materials are subject to an ion migration characteristic that can also limit operating life. An option to increase lifetime and allow more frequent operation than just cold starting was recognized to be applying alternating current (AC) to the glow plugs, in contrast to direct current (DC) power sources, as disclosed in U.S. Pat. No. 5,724,932, Mar. 10, 1998, and U.S. Pat. No. 5,809,957, Sep. 22, 1998. The patents disclose glow plug systems with AC power sources that include an alternator dependent on engine operation, such as one driven by a hydraulic pump system operated from the engine power train.

The above mentioned patents also are representative of art relating to controllers for modifying power applied to glow plugs according to certain conditions throughout operation of the engine. The controllers can comprise programmable microprocessors utilizing sensors and electronic signal technology of a general nature like that of widely used engine control systems, sometimes referred to as engine control modules (ECMs).

By way of further background, various different diesel engine fuel systems are known. They include some in which fuel is directly injected into the engine cylinders, without premixing with air in a manifold. In some advanced systems, the fuel is directly injected at or near the end of the compression stroke at pressures up to a maximum that is in excess of 20,000 psi. One type of direct injection system, referred to as a hydraulically actuated electronic unit injection (HEUI) fuel system creates the needed pressure hydraulically by a high pressure oil pump driven by the engine, so upon starting the engine is cold-cranked to get the pump pressure to a proper level. General background on such systems is contained in an article by M. Osenga, *Diesel Progress*, August 1998, pp. 82, 84, and 86.

Another aspect of current diesel technology is the interest in a capability of operating on different fuels besides common diesel fuel. Different fuels have different combustion characteristics that have been addressed in various ways, such as those described in a paper by R. L. Miller, et al., titled "Development of a Heavy-Duty, Flexible Fuel (Methanol-Diesel) Engine System", ASME, ICE-Vol. 27-3, Book No. 1011C, 1996, pp. 47–55.

SUMMARY OF THE INVENTION

The invention, in one aspect, provides an AC power source for glow plugs without requiring an electromechanical alternator and related elements driven by the engine.

A static (i.e., comprising solid state or other non-mechanical elements) power converter is provided for converting DC power, e.g. from a battery, to AC power. The static power converter, independent of engine operation, develops an AC output that is governed by a controller, such as one including a microprocessor, responsive to any of a variety of inputs to control the duty cycle of the converter and, thus to control the glow plug temperature.

Having a glow plug power source independent of the immediate engine operation opens up a wide range of available operating methods to enable smooth, reliable, and efficient starting and running.

Among the systems provided by the invention is one in which glow plug resistance, related to its temperature, is monitored by sensing glow plug voltage and current and determining in the controller if the resistance satisfies a pre-set range of operating conditions. A transformer can be provided to modify the AC voltage produced by the converter, if desired.

Operating methods provided by the invention include sensing, or calculating from other sensed parameters, engine temperature as well as glow plug temperature. A desired glow plug temperature can be maintained substantially continuously during and after starting including applying power to glow plugs when the engine has cooled due to light loading (e.g., coasting down hill). That helps insure a smooth continuous efficient combustion and a smooth transition when the load increases.

Also, utilizing this invention can improve cold starting operation. During a cold starting event, the controller can sense, while the engine is cranking, both the glow plug temperature and the pressure of the oil that actuates direct fuel injection. The controller can be programmed to allow fuel injection when the oil pressure has reached a high enough level for proper fuel injection and when the glow plug temperature is high enough to ensure fuel combustion. This will reduce white smoke emissions (emissions containing unburned fuel).

The improved glow plug systems and methods of the invention avoid the need for an alternator system or other engine dependent power source and they allow operating glow plugs sufficiently for smooth, efficient fuel combustion while the glow plugs get a moderate, or optimum, power that achieves relatively long operating lives. The glow plug systems of the invention can be advantageously used in a variety of diesel engines and with any of a variety of fuels by tailoring the glow plug system to a particular type of engine, fuel system and fuel composition, including systems with changes in fuel composition.

These and other aspects of the present invention will become more apparent from the following description.

DESCRIPTION INCLUDING PREFERRED EMBODIMENTS

Figure 1:
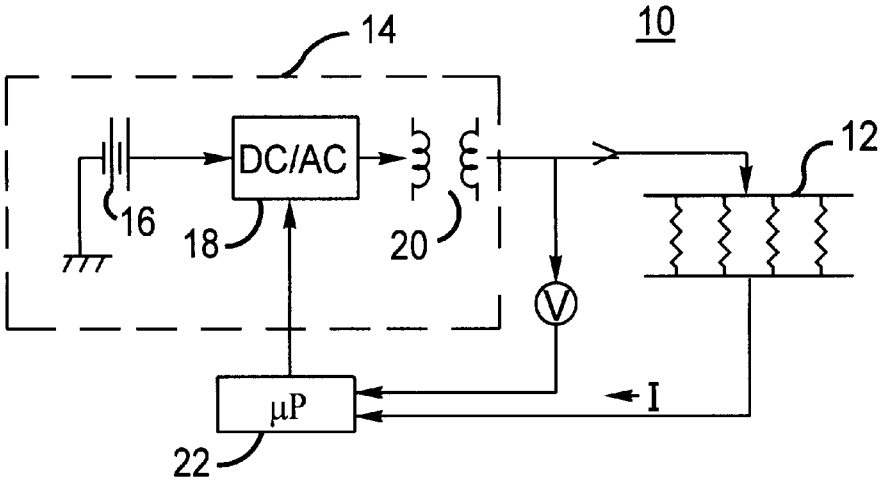
FIG. 1 is a schematic block diagram of a system in accordance with the invention.

Referring to FIG. 1, an engine glow plug system 10 is illustrated that includes glow plugs 12 which are in respective cylinders of a multi-cylinder internal combustion engine (not shown). The glow plugs 12, which are resistive heating elements, are supplied electrical energy from an alternating current (AC) power source 14 including a direct current (DC) source, such as a battery 16, and a DC to AC converter 18. The converter 18 is connected to convert the DC power of battery 16 to AC power applied to the glow plugs 12.

Figure 2:
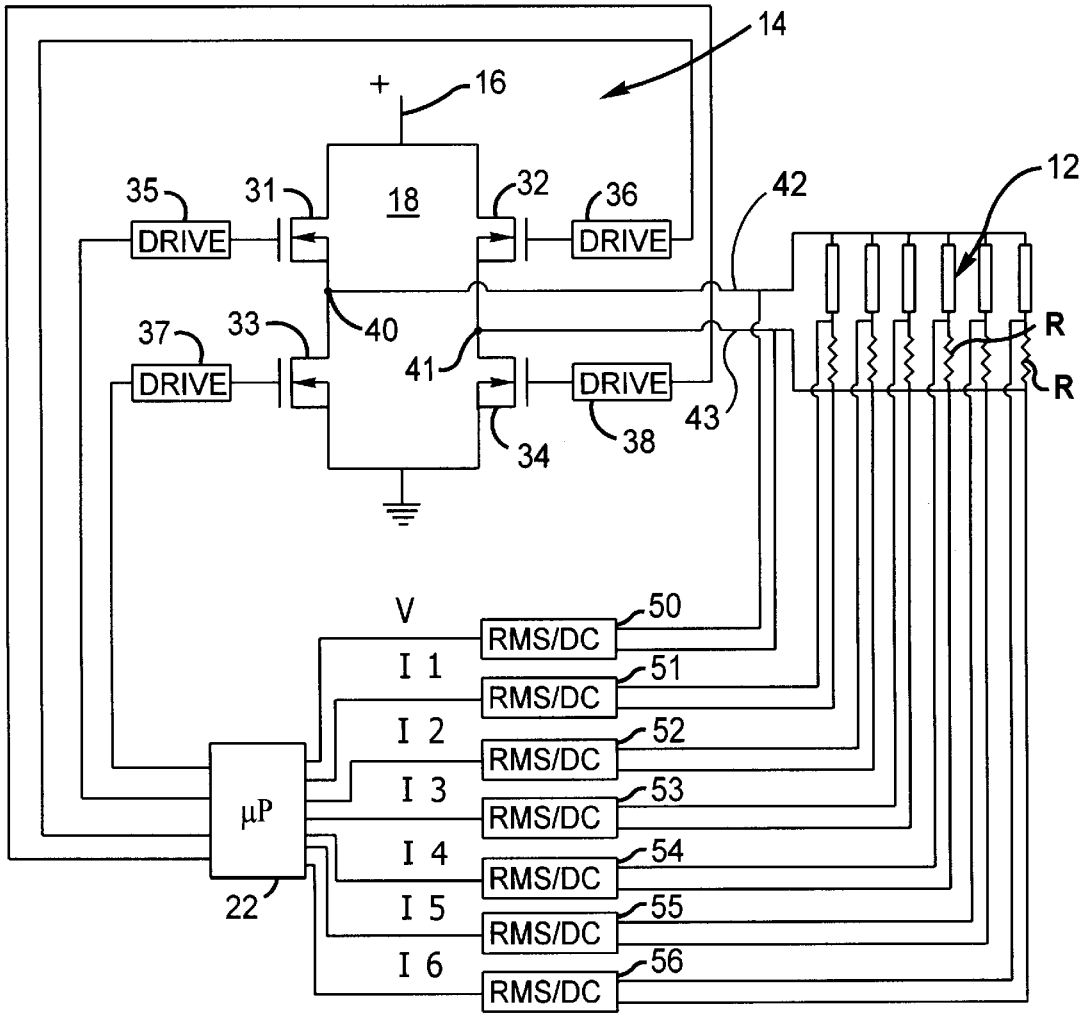
FIG. 2 is a circuit schematic of a glow plug system.

The converter 18 (sometimes referred to as a static converter) is made up of solid-state elements such as a plurality of switching transistors connected in an H-bridge, as further described in reference to FIG. 2. FIG. 1 includes a transformer 20 that receives AC voltage from the converter 18 and steps it up to a desired level. Transformer 20 can be variously arranged. For example, transformer 20 can be switchably interconnected to step-up the voltage only when the converter output falls below a threshold, such as due to the battery having a low voltage level. The battery 16 may be arranged to be re-charged during engine operation.

The system 10 further includes a controller 22, labeled "$\mu$p" for a microprocessor with a programmable memory; a variety of other electronic signal processing elements may be included in controller 22. Controller 22 is connected with converter 18 to control the duty cycle of the converter. Controller 22, specifically discussed here in connection with control of power to the glow plugs 12, may be part of a more comprehensive electronic control for controlling numerous functions in the engine system, some of which are discussed in connection with FIG. 3.

Controller 22 can turn the converter 18 on or off according to various parameters in accordance with a predetermined strategy programmed into the controller. In general, the strategy is to operate the power source 14 enough to have the glow plugs reach or stay at a desired temperature or change from one temperature to another upon a predetermined change of conditions.

A general objective in the operation of the controller 22 and converter 18 is to minimize the extent of heating, both in time and in temperature rise, of the glow plugs 12. Preferably, the glow plugs 12 are durably constructed, such as by comprising a durable ceramic (e.g. silicon nitride). Even such durable glow plugs are subject to shorter life if used for long times and/or at high temperatures, even with AC.

To help prolong the life of the glow plugs 12, in system 10 controller 22 is arranged to receive signals representing the voltage V applied to the glow plugs and the current I carried by them. Here, all the glow plugs 12 are treated collectively although it is apparent that the sensing and control functions may be performed otherwise. From V and I signals, controller 22 can develop a signal representing the resistance of the glow plugs and, hence, their temperature. That resistance signal can be compared, in the controller 22, with a desired set point (or in accordance with a control map) and the duty cycle of the converter 18 adjusted, if necessary, to achieve a desired temperature. The system 10 can be modified to include sensors providing other signals to the controller 22. For example, the invention is not confined just to maintaining a constant glow plug temperature but, also, allows optimizing glow plug operation according to a variety of engine operating conditions, some of which will be described below in connection with FIG. 3.

FIG. 2 presents a more detailed schematic of an example of converter 18 and certain other elements of system 10. FIG. 2 shows an AC power source 14 with DC/AC static converter 18 comprising four transistors 31, 32, 33 and 34 connected in an H-bridge. In this example, each of the transistors 31 through 34 is an N-channel MOSFET. Pairs of the transistors conduct DC through their source to drain channels between a ground potential and battery 16 as determined by the controlled operation of their respective gate drive circuits 35, 36, 37 and 38. AC output terminals 40 and 41 carry an alternating current to the glow plugs 12.

For example, when transistor 31 is on and transistor 33 is off, terminal 40 has a relatively high potential; when transistor 32 is off and transistor 34 is on, terminal 41 has a relatively low potential. Timing the switching of the respective transistors between on and off states causes an AC voltage to appear across terminals 40 and 41.

The drive circuits 35 through 38 typically include an amplifier. Drivers 35 through 38 are under the control of a microcontroller or microprocessor in controller 22 that typically produces signals of a relatively low voltage level that is amplified by the drive circuits to a level suitable for the transistors 31–34. Controller 22 sets the frequency of AC at terminals 40 and 41 (e.g., 400 Hz) and, more significantly to the present invention, controls the duty cycle (on or off time) of the converter 18. The DC/AC converter 18 may be formed by use of known converter techniques.

Glow plugs 12, six in number in this example, have the AC applied to them, and also to a respective current sensing resistor R, by leads 42 and 43 from the respective terminals 40 and 41. Each of the glow plugs 12 and resistors R may be substantially alike but it can be useful to have the ability to sense the current through the individual glow plugs. Having individual sense resistors for each of the glow plugs allows the system to operate so individual cylinders of the engine do not receive fuel if the respective glow plug has failed.

AC voltage is sensed from leads 42 and 43 and applied to an RMS/DC converter 50 to develop a voltage signal V applied as an input to controller 22. The currents through respective sense resistors R are sensed from the voltages across the respective resistors and applied to respective RMS/DC converters 51, 52, 53, 54, 55 and 56 to develop DC voltages representing current signals I1, I2, I3, I4, I5 and I6 applied to the controller 22. The various voltage and current signals are fed back to controller 22 and are processed in the controller relative to programmed values to determine glow plug resistance which is related to temperature.

Sense resistors R need only be of a very small value, such as about 0.1 ohm each. They are substantially smaller than the resistance of the glow plugs 12, which may be about 3 ohms each. RMS/DC converters 50 through 56 can be known and commercially available integrated circuits for developing DC signals to a microprocessor. The AC signals applied to converters 50–56 are integrated to produce RMS values converted to the DC outputs.

It will be apparent that numerous variations may be made in the circuitry of FIG. 2 in accordance with known signal sensing and processing techniques. For example, if DC source potentials of + and − a given voltage are used, then a half-bridge may be used to convert to AC, in accordance with known DC/AC conversion techniques.

Figure 3:
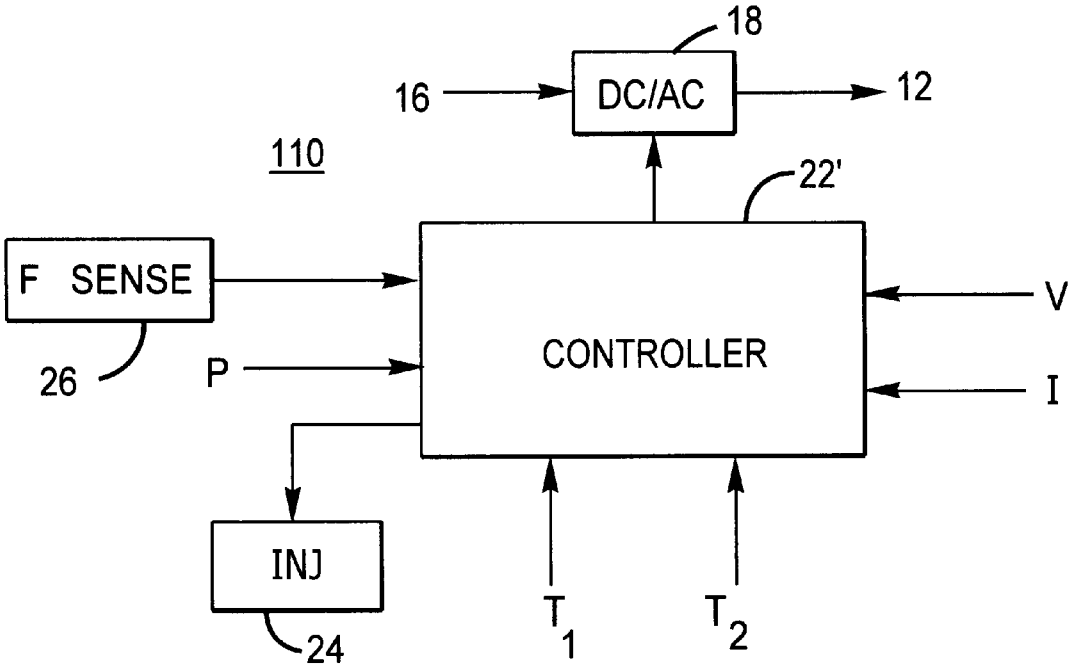
FIG. 3 is a schematic block diagram of a system.

FIG. 3 shows a glow plug system 110 with some additional capability to that of system 10 of FIG. 1. Controller block 22', represents electronic signal processors for controlling converter 18 as well as other functions. FIG. 3 is configured to include additional input signals to controller 22'. These can include, for example, a signal T1 representing inlet air temperature to the engine and/or a signal T2 representing engine coolant temperature. Such information can help insure the glow plug temperature is adjusted according to a pre-set program or control map to improve performance. The desired glow plug temperature during cold starting of the engine may be higher than after starting and during smooth running. A goal is to operate with the minimum glow plug resistance that is sufficient while maximizing performance.

Engine inlet air temperature and engine coolant temperature can vary under circumstances other than whether the engine is cold starting or not. For example, if an engine has been operating for a period, cold starting is not an issue but the engine load can vary considerably. If the engine runs with a low load, e.g. the vehicle coasts downhill, the coolant temperature may drop and a higher glow plug temperature may be desirable. Also, an increase in load may raise a need for fast response from the glow plugs to get a smooth transition in engine performance.

In addition, FIG. 3 illustrates a relation of the engine's fuel system to how the glow plugs are controlled. Fuel systems for diesel engines, such as the HEUI fuel system mentioned in the Background, include those in which a fuel is injected through fuel injectors (represented by block INJ 24) directly into each cylinder which is under approximately maximum compression. An oil pump operated under engine power raises the fuel pressure. A certain minimum engine oil pressure is desirable or injected fuel is likely to be wasted. By the invention, once a starting cycle begins, and the engine is subjected to cold cranking which builds up the oil pressure, the fuel to the fuel injectors is not activated until the minimum required pressure is reached. Also, the fuel injection is delayed until a desired glow plug temperature has been reached. The controller 22' is programmed to respond to the engine oil pressure P as well as to the V and I signals related to glow plug temperature. When these parameters are proper, a signal to injectors 24 will initiate injection of fuel that can be efficiently burned.

FIG. 3 also illustrates another aspect of control of the glow plug system 110. Different fuels have different combustion characteristics, including a cetane number; lower cetane number fuels generally require more heat from the glow plugs for efficient combustion than do higher cetane number fuels. A gas such as natural gas or methanol has a lower cetane number than common diesel fuel and the controller 22' can be programmed to take into account the cetane number of a particular fuel. As a further option, the programming of controller 22' can be variable according to a signal from a fuel composition sensor 26, such as one of the type described in the above-mentioned paper of Miller et al. That allows the glow plug system to adjust to a change of fuel composition without other intervention.

The glow plug operating techniques of the invention allow optimizing the ignition system for any of a wide range of fuels, including, for example, diesel fuel oil, natural gas, other combustible gases, and gasoline. Gasoline is not commonly used in diesel engines but in the particular systems described there is the opportunity to use gasoline in a diesel engine, such as a direct injected fuel engine, with greater efficiency than in an Otto cycle engine with spark ignition.

The various functions described in reference to FIG. 3 need not all be employed in the same glow plug system. It is also to be understood that the invention may be practiced in various forms other than those specifically described herein.

INDUSTRIAL APPLICABILITY

The various techniques disclosed contribute to improved engine performance while maximizing glow plug life.

It is not necessary to have an additional alternator as an AC power source because a static converter is used. The static converter, which is independent of engine operation, is controllable to achieve a variety of glow plug operating conditions. Methods of the invention can be applied with any of a wide variety of fuels.

Misfiring and excessive hydrocarbon emissions can be avoided and greater fuel efficiency can be attained, particularly, but not limited to, engines with direct injected fuel systems. Smooth engine operation in a continuous, seamless, manner can be achieved both during starting and running.

What is claimed is:

1. An engine glow plug system comprising:

glow plugs in respective cylinders of a multicylinder diesel cycle engine where the glow plugs each include a ceramic material with an ion conduction characteristic;

an alternating current (AC) power source arranged to apply AC power to the glow plugs, said power source comprising a converter, and a direct current (DC) source applying input DC power to the converter, where the converter is a static converter connected to convert the DC power to AC power applied to the glow plugs; and a controller connected with the converter to control a duty cycle of the converter.

2. An engine glow plug system comprising:

glow plugs in respective cylinders of a multicylinder diesel cycle engine receiving a directly injected fuel;

an alternating current (AC) power source arranged to apply AC power to the glow plugs, said power source comprising a converter, and a direct current (DC) source applying input DC power to the converter, where the converter is a static converter connected to convert the DC power to AC power applied to the glow plugs; and a controller connected with the converter to control a duty cycle of the converter.

3. The system of claim 2 wherein:

the direct injected fuel is from a source of a fuel selected from the group consisting essentially of diesel fuel, natural gas, other combustible gases, gasoline and mixtures thereof.

4. The system of claim 3 further comprising:

a fuel sensor arranged to sense information related to fuel composition and to provide signals to the controller according to combustion characteristics of the fuel.

5. The system of claim 3 wherein:

the controller is programmed to operate in response to the fuel's cetane number, wherein glow plug heating is greater for a low cetane number fuel than for a higher cetane number fuel.

6. An engine glow plug system comprising:

glow plugs in respective cylinders of a multicylinder diesel cycle engine;

an alternating current (AC) power source arranged to apply AC power to the glow plugs, said power source comprising a converter, and a direct current (DC) source applying input DC power to the converter, where the converter is a static converter connected to convert the DC power to AC power applied to the glow plugs; and a controller connected with the converter to control a duty cycle of the converter with the controller receiving signals representing voltage (V) applied to the glow plugs and current (I) in the glow plugs.

7. The system of claim 6 wherein:

the DC source is a battery; and, a transformer is arranged to receive AC power produced by the converter and to apply a transformed level of AC voltage to the glow plugs.

8. The system of claim 6 wherein:

the controller is arranged to process the glow plug voltage (V) and current (I) signals to produce a signal representing glow plug resistance and to compare the glow plug resistance signal to a desired set point for adjusting the voltage applied to the glow plugs to produce a desired glow plug resistance.

9. An engine glow plug system comprising:

glow plugs in respective cylinders of a multicylinder diesel cycle engine;

an alternating current (AC) power source arranged to apply AC power to the glow plugs, said power source comprising a converter, and a direct current (DC) source applying input DC power to the converter, where the converter is a static converter connected to convert the DC power to AC power applied to the glow plugs and includes a plurality of switching transistors connected in an H-bridge configuration; and a controller connected with the converter to control a duty cycle of the converter.

10. The system of claim 9 wherein:

the transistors of the H-bridge have respective drive circuits to which turn-on and turnoff signals are applied by the controller to vary the RMS value of AC voltage at bridge output terminals applied to the glow plugs;

the RMS value of the AC voltage is applied to an RMS/DC converter to produce a DC voltage signal applied to the controller corresponding to the RMS value; and the glow plugs have a sense resistor in series therewith across which an AC voltage is developed related to AC current therein and applied to an RMS/DC converter to produce another DC voltage signal applied to the controller corresponding to the AC current.

11. An engine glow plug system comprising:

glow plugs in respective cylinders of a multicylinder diesel cycle engine;

an alternating current (AC) power source arranged to apply AC power to the glow plugs, said power source comprising a converter, and a direct current (DC) source applying input DC power to the converter, where the converter is a static converter connected to convert the DC power to AC power applied to the glow plugs; and a controller connected with the converter to control a duty cycle of the converter with the converter arranged to receive one or more input signals representing one or more engine and glow plug conditions and to process the input signals to achieve a desired glow plug temperature according to a predetermined strategy with the glow plug temperature at a minimum level sufficient for efficient combustion to prolong glow plug life.

12. The system of claim 11 wherein:

the one or more input signals to the controller include one or more signals (T1, T2) representing engine inlet air temperature and engine coolant temperature.

13. The system of claim 11 wherein:

the glow plugs are in an engine receiving direct injected fuel from a fuel injection system dependent on fluid pressure generated by the engine; and, the engine is arranged for cold starting with the glow plugs brought to the desired temperature and the engine fluid pressure brought to a desired minimum level from cranking during heating of the glow plugs, before initiation of fuel injection.

14. The system of claim 13 wherein:

the engine has an engine fuel injection controller interrelated with the controller of the converter for glow plug power and the engine fuel injection controller is arranged to avoid fuel injection absent a desired glow plug temperature and a desired engine fluid pressure (P).

15. A method of operating a diesel engine glow plug system having glow plugs in respective cylinders and a power source for energizing the glow plugs independent of engine running, comprising the steps of:

sensing parameters representing engine temperature and glow plug temperature;

maintaining a controlled glow plug temperature substantially continuously during and after engine starting including responding to engine cooling resulting from lightly loaded running of the engine by applying controlled power to the glow plugs during light load conditions while ensuring a smooth transition to running at a higher load level.

16. The method of claim 15 further comprising:

supplying to the engine a fuel selected from the group consisting essentially of diesel fuel, natural gas, other combustible gases, gasoline, and mixtures thereof.

17. The method of claim 16 further comprising:

powering the glow plugs from a power source comprising a static converter of DC to AC power without use of an electromechanical alternator.

18. The method of claim 16 wherein:

the maintaining of a controlled glow plug temperature is performed in a manner taking into account the combustion characteristics of the fuel whereby less power is applied to the glow plugs when operated with a higher cetane number fuel than when operated with a lower cetane number fuel and glow plug life is prolonged by minimizing applied power.

19. The method of claim 20 further comprising:

sensing information related to the composition of the fuel supplied.

20. A method of operating a diesel engine glow plug system having glow plugs in respective cylinders and a power source for the glow plugs independent of engine running, where the engine has a fuel system dependent on an engine oil pressure for direct injection of fuel into the cylinders, comprising the steps of:

initiating an engine start phase including cold cranking of the engine and supply of power to the glow plugs;

sensing glow plug temperature and engine oil pressure;

determining predetermined conditions at which the engine oil pressure is suitable for fuel injection and the glow plug temperature is suitable for fuel combustion; and injecting fuel into the engine only during both the described conditions of engine oil pressure and glow plug temperature.

21. The method of claim 20 wherein:

the injecting of the fuel is of a fuel selected from the group consisting essentially of diesel fuel, natural gas, other combustible gases, gasoline, and mixtures thereof.

22. The method of claim 21 further comprising:

powering the glow plugs from a power source comprising a static converter of DC to AC power without use of an electromechanical alternator.

23. The method of claim 21 wherein:

determining a temperature suitable for fuel combustion is performed in a manner taking into account the combustion characteristics of the fuel whereby less power is applied to the glow plugs when operated with a higher cetane number fuel than when operated with a lower cetane number fuel and glow plug life is prolonged by minimizing applied power.

24. The method of claim 23 further comprising:

sensing information related to the composition of the fuel supplied.

* * * * *